US006648137B2

(12) United States Patent
Hamamori

(10) Patent No.: US 6,648,137 B2
(45) Date of Patent: Nov. 18, 2003

(54) BOTTOM STRUCTURE OF A GOLF BAG HAVING A SLIP-STOPPING FUNCTION AND AN IMPACT ABSORBING FUNCTION

(75) Inventor: Tatsuro Hamamori, Kyoto (JP)

(73) Assignee: Kisai Kobo Co., Ltd., Kyoto (JP)

( * ) Notice: Subject to any disclaimer, the term of this patent is extended or adjusted under 35 U.S.C. 154(b) by 0 days.

(21) Appl. No.: 09/974,877

(22) Filed: Oct. 12, 2001

(65) Prior Publication Data

US 2002/0043474 A1 Apr. 18, 2002

(30) Foreign Application Priority Data

Oct. 16, 2000 (JP) ..... 2000-315736

(51) Int. Cl.[7] ..... A63B 55/00
(52) U.S. Cl. ..... 206/315.3; 206/315.8
(58) Field of Search ..... 248/96; 211/70.2; D3/255; 206/315.3, 315.5–315.8; 190/18 R

(56) References Cited

U.S. PATENT DOCUMENTS 1,452,084 A * 4/1923 Luckett ..... 206/315.7
1,902,644 A * 3/1933 Hotze ..... 206/315.3
3,674,072 A * 7/1972 Shuto ..... 206/315.3
3,987,875 A * 10/1976 Szabo ..... 190/18 R X
4,071,062 A * 1/1978 Ianetta ..... 206/315.7
4,332,283 A * 6/1982 Rader ..... 206/315.3
5,102,529 A * 4/1992 Hickin ..... 206/315.3
D330,631 S * 11/1992 Ledbetter ..... D3/255
5,450,955 A * 9/1995 Olson ..... 206/315.3 X
5,725,095 A * 3/1998 Beck et al. ..... 206/315.8
6,148,998 A * 11/2000 Tan ..... 206/315.3
D435,723 S * 1/2001 Shin ..... D3/255
6,298,988 B1 * 10/2001 Wen-Chien ..... 206/315.7
6,315,117 B1 * 11/2001 Han ..... 206/315.7

* cited by examiner

*Primary Examiner*—Sue A. Weaver
(74) *Attorney, Agent, or Firm*—Keating & Bennett, LLP

(57) ABSTRACT

A golf bag has a bottom structure that prevents the bag from slipping when placed on the ground, is excellent in cushioning property, and offers a wide design variety. A golf bag includes a bottom unit having a substantially cylindrical bottom structure disposed on an underside of a golf bag main body. A plurality of supporting legs are detachably attached to the golf bag main body, and the supporting legs include at least one portion that is arranged on a lower end surface of the bottom unit. The supporting leg members are preferably made of a non-slipping elastic material having a high friction coefficient and a cushioning property.

8 Claims, 7 Drawing Sheets

BOTTOM STRUCTURE OF A GOLF BAG HAVING A SLIP-STOPPING FUNCTION AND AN IMPACT ABSORBING FUNCTION

BACKGROUND OF THE INVENTION

A. Field of the Invention

The present invention relates to a golf bag.

B. Description of the Prior Art

FIG. 7 is a perspective view showing a bottom structure of a conventional golf bag relating to the present invention. In the bottom structure of this conventional golf bag, a bottom unit 1 includes a plurality of legs 3 spaced on its undersurface so as to extend circumferentially. The legs 3 support the golf bag when the golf bag is placed on the ground. The bottom unit 1 and the plurality of legs 3 are integrally formed with one another using a hard plastic material, for example. In this case, the plurality of legs 3 each have a flat-shaped undersurface.

Moreover, in the conventional bottom structure, the bottom unit 1 has a ring-like flange portion 7 disposed along its outer peripheral surface 5. In this case, a golf bag body (not shown) is, at its lower end, fitted and fixed to a portion of the peripheral surface 5 located above the flange portion 7 via sewing, whereby the golf bag body is attached to the bottom unit 1. In the bottom structure of this conventional golf bag, however, the distance from the lower edge of the bottom unit 1 to the flange portion 7 is small. This makes it difficult to print patterns or graphics on this area of the bottom unit for decorative purposes.

Moreover, the bottom structure of this conventional golf bag shown in FIG. 7 has the following disadvantages. Firstly, the undersurface of each of the plurality of legs 3, which makes contact with the ground, is made of a hard plastic material and has a flat shape. This produces slippage and a poor cushioning effect. Thus, this conventional golf bag tends to be unsteady when placed on the ground, and when shocks are applied to the golf bag, the legs 3 are often damaged or the golf clubs contained in the golf bag are damaged. Moreover, when the conventional golf bag is used for a long period of time, the undersurfaces of the plurality of legs 3 wear unevenly. This causes the golf bag that is placed on the ground to be unsteady, and to lean in one direction, which causes the golf bag to fall over.

Secondly, the plurality of legs 3 are integrally formed with the bottom unit 1, as shown in FIG. 7. Thus, if the user wishes to change the design of the legs 3 after the conventional golf bag is used for a given length of time, the design cannot be easily changed. That is, the design of the conventional golf bag's bottom structure shown in FIG. 7 lacks design flexibility.

SUMMARY OF THE INVENTION

To overcome the above-described problems, preferred embodiments of the present invention provide a golf bag having a bottom structure that prevents the bag from slipping when placed on the ground, has outstanding cushioning properties, and has outstanding design flexibility.

According to preferred embodiments of the present invention, a golf bag includes a golf bag main body, a bottom unit disposed on an underside of the golf bag main body, and a supporting leg member detachably attached to the bottom unit, of which at least one portion is located on a lower end surface of the bottom unit, wherein the supporting leg member is made of a non-slip elastic material having a high friction coefficient and an excellent cushioning property.

It is also effective to provide a roughened surface on a portion of the surface of the supporting leg member that makes contact with the ground.

The supporting leg member may preferably include at least a portion extending over an outer peripheral surface of the bottom unit, such that a decorative portion is disposed thereon.

Inside the bottom unit, a cushion member may preferably be provided, the cushion member being made of an elastic material having a cushioning property.

In the golf bag according to preferred embodiments of the present invention, the supporting leg member is detachably attached relative to the bottom unit, i.e. the leg member can be retrofitted to the bottom unit. Therefore, the supporting leg member can be replaced with another leg member as the user desires. Moreover, the supporting leg member is made of a non-slipping elastic material that has a high friction coefficient and a cushioning property. This protects the golf bag against slippage and helps prevent shocks when placed on the ground.

Moreover, by providing a roughened surface on the portion of the surface of the supporting leg member that makes contact with the ground, the slip ratio is further reduced, such that the slippage prevention effect is greatly improved.

Further, it is preferable that the supporting leg member includes at least a portion extending over the outer peripheral surface of the bottom unit to provide a decorative portion. By doing so, for example, the supporting leg member can be replaced with a new one having a design such as a shape, pattern, and color that suits the user's preferences. This increases the degree of flexibility in decoration.

Still further, providing a cushion member inside the bottom unit is preferable. The action of the cushion member and the cushioning property of the supporting leg member combine to greatly absorb the shock exerted upon the bottom unit and the lower end portion of the golf clubs accommodated in the golf bag when the golf bag is placed on the ground.

These and other features, elements, characteristics and advantages of the present invention will become clear from the following detailed description of preferred embodiments of the present invention with reference to the accompanying drawings.

DETAILED DESCRIPTION OF PREFERRED EMBODIMENTS

Figure 1:
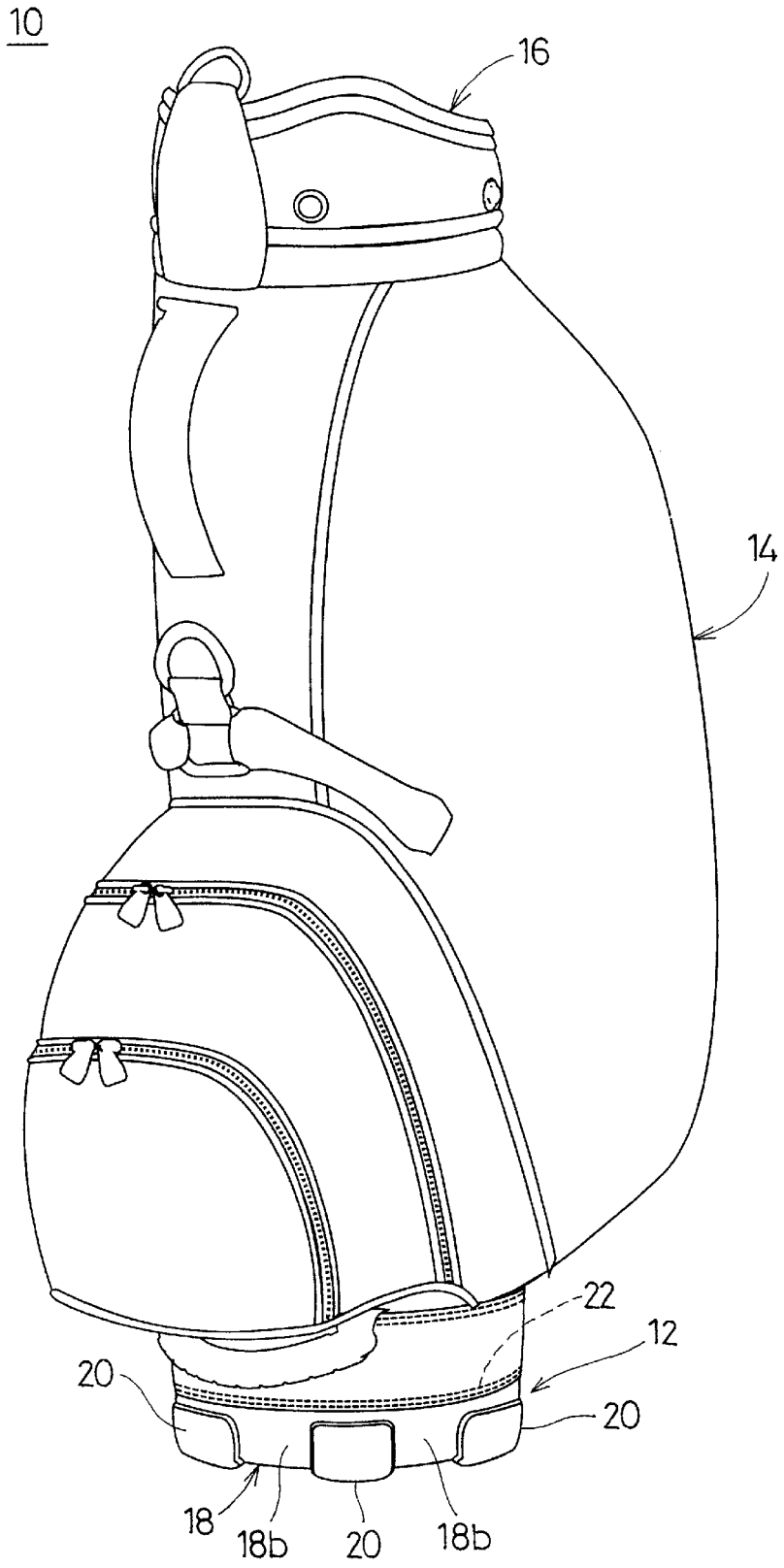
FIG. 1 is a perspective view showing a preferred embodiment according to the present invention.
Figure 2:
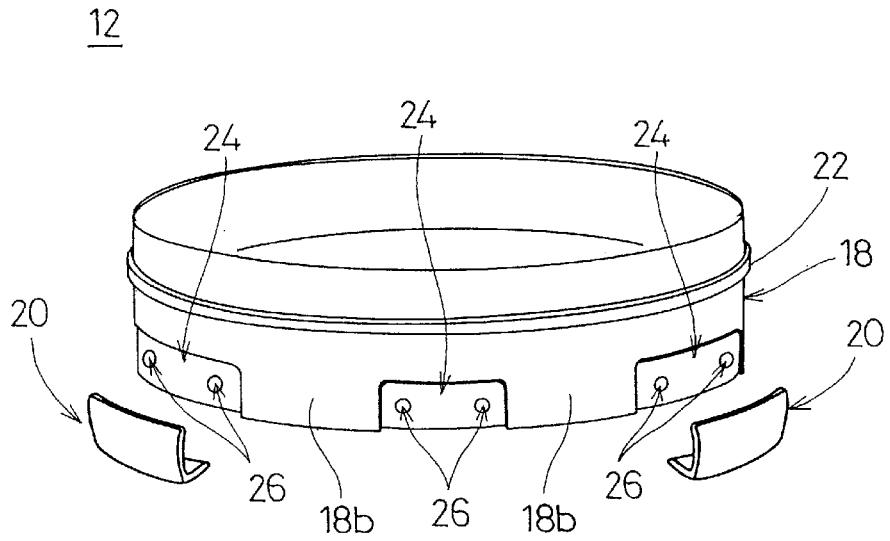
FIG. 2 is an exploded perspective view showing an external configuration of a bottom structure included in the preferred embodiment shown in FIG. 1.

FIG. 1 is a perspective view showing a preferred embodiment of the present invention, and FIG. 2 is an exploded perspective view showing an external configuration of the bottom structure of a preferred embodiment shown in FIG. 1. According to the present preferred embodiment, a golf bag 10 preferably includes a bottom 12 having a substantially cylindrical bottom structure. A golf bag main body 14 is provided on the bottom 12 and includes an open frame portion 16 provided in its upper portion. A hood is detachably provided on the open frame portion 16 (not shown). The bottom 12 of the golf bag 10 includes a bottom unit 18 having a plurality of supporting leg members 20 detachably disposed therein. The supporting leg members 20 are disposed in the bottom unit 18 so as to extend across a lower end surface 18*a* and an outer peripheral surface 18*b*.

The bottom unit 18 has, for example, a ring-like flange piece 22 provided along its outer peripheral surface. The flange piece 22 is integrally formed with the bottom unit 18 using, for example, a plastic material. In this case, a distance from the lowermost edge of the bottom unit 18 to the flange piece 22 is greater than a distance from the uppermost edge of bottom unit 18 to the flange piece 22.

Figure 3A:
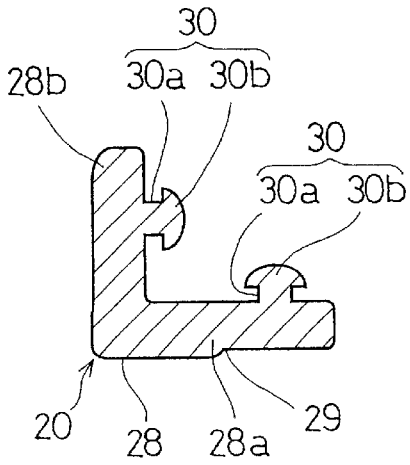
FIG. 3(A) is an illustrative sectional view showing a supporting leg member included in the preferred embodiment shown in FIGS. 1 and 2.
Figure 3B:
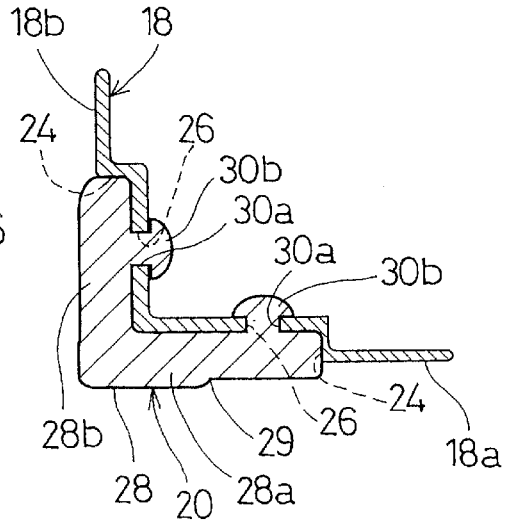
FIG. 3(B) is an illustrative sectional view showing one example of a mounting structure for the supporting leg member and the bottom unit.

As shown in FIGS. 2 and 3(B), the bottom unit 18 includes a plurality of stepped recess portions 24 provided therein to extend across the peripheral-edge side of the lower end surface 18*a* and a portion of the outer peripheral surface 18*b*. The plurality of stepped portions 24 are provided in circumferentially spaced relation around the outer peripheral surface 18*b*, and, for example, configured in a substantially rectangular shape when viewed from the front. Moreover, the plurality of stepped portions 24 each have, for example, two transversely spaced apart through holes 26 preferably having a substantially circular shape.

Meanwhile, as shown particularly in FIGS. 3(A) and 3(B), the supporting leg member 20 has a supporting leg body 28 preferably having a substantially L-shaped cross section. The supporting leg body 28 includes a bottom-side piece 28*a* arranged on the lower end surface 18*a* of the bottom unit 18 and a peripheral-side piece 28*b* arranged on the outer peripheral surface 18*b* of the bottom unit 18. The bottom-side piece 28*a* has on its outer surface a slightly stepped portion 29 and has on its opposite inner surface a snap retaining piece 30. The snap retaining piece 30 includes, for example, a substantially cylindrical neck portion 30*a* and a substantially spherical crown-shaped retainer 30*b* contiguous with the neck portion 30*a*. Moreover, the peripheral-side piece 28*b* has substantially flat shaped outer surface and has on its opposite inner surface a snap retaining piece 30 having the same structure as that of the above-described snap retaining piece 30.

The supporting leg member 20 is defined by the supporting leg body 28 including the bottom-side piece 28*a*, the peripheral-side piece 28*b*, and the four snap retaining pieces 30 that are integrally formed with one another using a non-slipping elastic material that possesses a high friction coefficient and a cushioning property. Note that, examples of the material of the supporting leg member 20 include a rubber material such as soft rubber and expanded rubber, a soft plastic material such as urethane and polyurethane, and other cushion materials possessing a relatively high friction coefficient.

In this preferred embodiment, the snap retaining piece 30 of the supporting leg member 20 is inserted through the through hole 26 provided on the lower end surface 18*a* and the outer peripheral surface 18*b* of the bottom unit 18 under the elastic force of the snap retaining piece 30. At this time, the snap retaining piece 30 has its neck portion 30*a* retained in the through hole 26, and has its retainer 30*b* retained in the inner surface of the bottom unit 18. In this case, the retainer 30*b* prevents the supporting leg member 20 from slipping off. The snap retaining piece 30 is engaged in the through hole 26 with a single motion. This facilitates the detachment and attachment of the supporting leg member 20 to the bottom unit 18.

In this preferred embodiment, in accordance with the user's preferences, patterns, graphics, characters, or color can be created or applied on the surface of the periphery-side piece 28*b* of the supporting leg member 20. In this way, various ornaments can be added to the supporting leg member 20. In addition, the shape and size of the bottom-side piece 28*a* and the peripheral-side piece 28*b* of the supporting leg member 20 can be modified. Consequently, the supporting leg member 20 offers outstanding design flexibility, and can be detachably attached to the bottom unit 18. In other words, in the bottom structure of the present preferred embodiment, the design of the supporting leg member 20 can be changed in accordance with the user's preferences, and the design flexibility of the bottom unit 18 is accordingly greatly increased.

Figure 4:
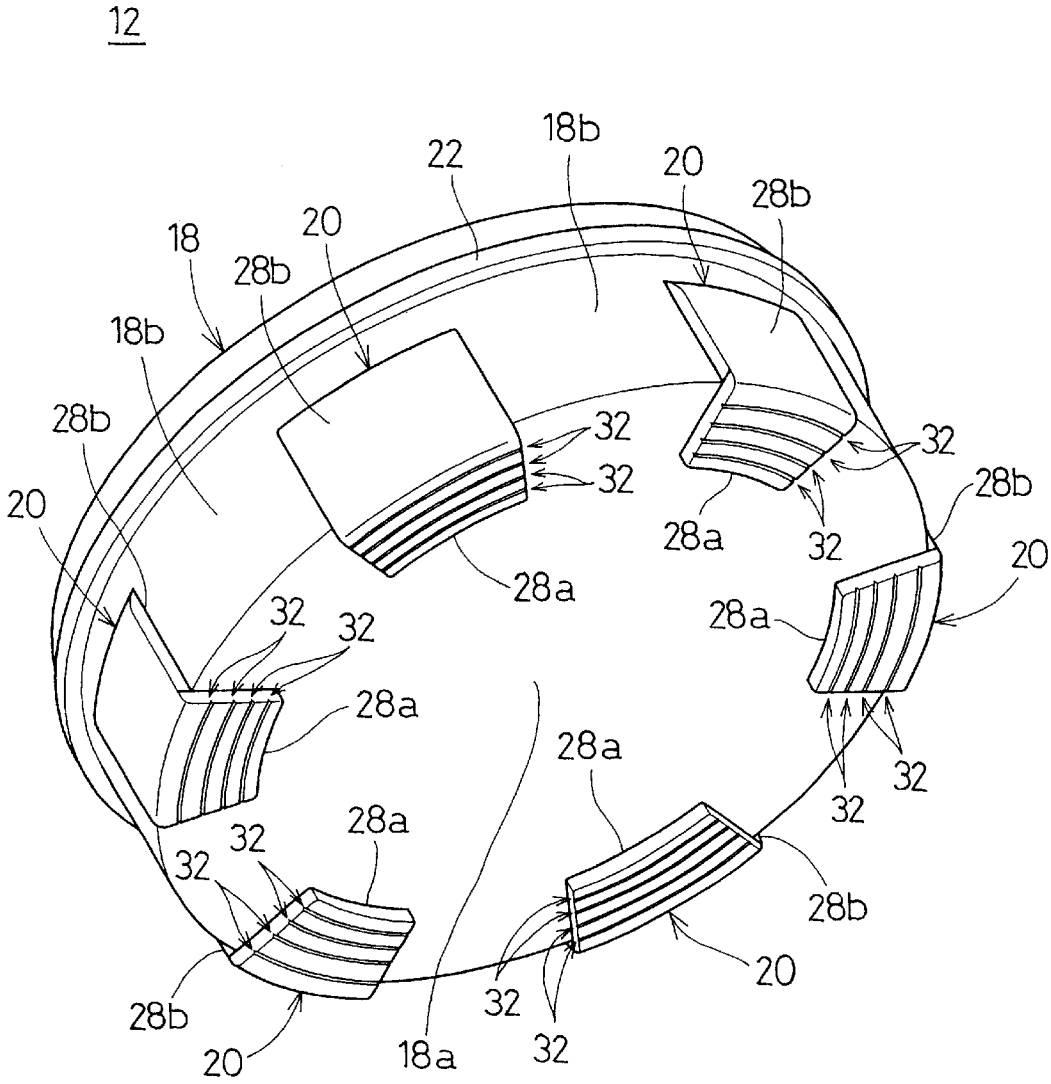
FIG. 4 is a perspective view showing another preferred embodiment of the present invention as seen from the undersurface side.

FIG. 4 is a perspective view showing another preferred embodiment of the present invention as seen from the undersurface side. The preferred embodiment shown in FIG. 4 differs from that shown in FIGS. 1 to 3 primarily in that a roughened surface is provided on a bottom-side surface 28*a* of its supporting leg member 20. That is, in this preferred embodiment, on a portion of the surface of the supporting leg member 20 that comes in contact with the ground, a roughened surface, such as, a plurality of groove lines 32, are provided. The plurality of groove lines 32 are concentrically spaced so as to extend circumferentially relative to the bottom unit 18.

Thus, in the bottom structure of the present preferred embodiment, the slip ratio is greatly reduced by the plurality of groove lines 32 or other suitable roughened surface structure, such that the slippage prevention effect is further improved.

Figure 5:
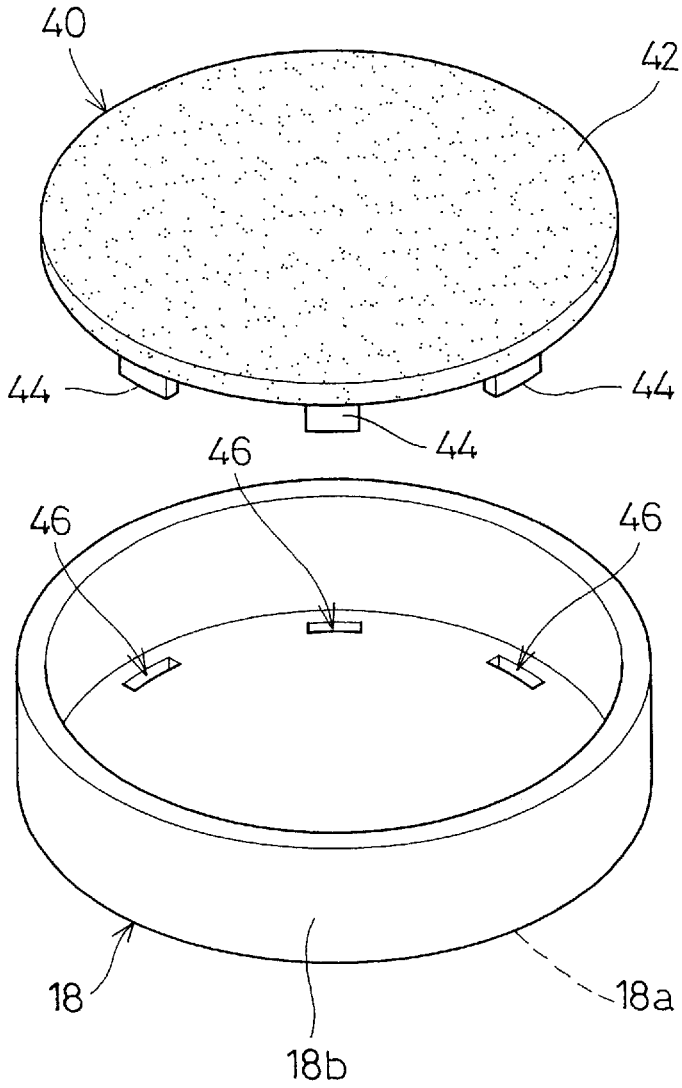
FIG. 5 is an exploded perspective view showing one example of a cushion member and its mounting structure, the cushion member being arranged within the bottom unit having the bottom structure according to a preferred embodiment of the present invention.

In any of the above-described preferred embodiments, the bottom unit 18 of the golf bag 10 has, as shown in FIG. 5, a cushion member 40 disposed therein. The member 40 is made of, for example, an elastic material having a cushioning property. The cushion member 40 includes a circular cushion body 42. The cushion body 42 has a plurality of retaining legs 44 provided in circumferentially spaced relation around the periphery of its lower end surface. The cushion body 42 and the retaining legs 44 are integrally formed with one another using a cushion material such as expanded urethane resin. Moreover, the bottom unit 18 has, in its inner bottom surface, retaining holes 46 corresponding to the retaining leg pieces 44. The retaining leg pieces 44 are fitted into their respective retaining holes 46, whereby the cushion body 42 is placed inside the bottom unit 18.

Figure 6A:
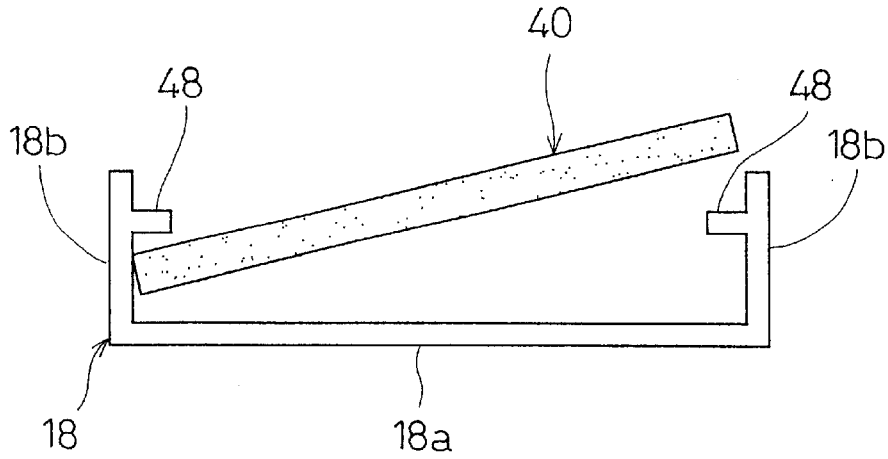
FIGS. 6(A) and 6(B) are exploded sectional views showing another example of a mounting structure for the cushion member shown in FIG. 5.
Figure 6B:
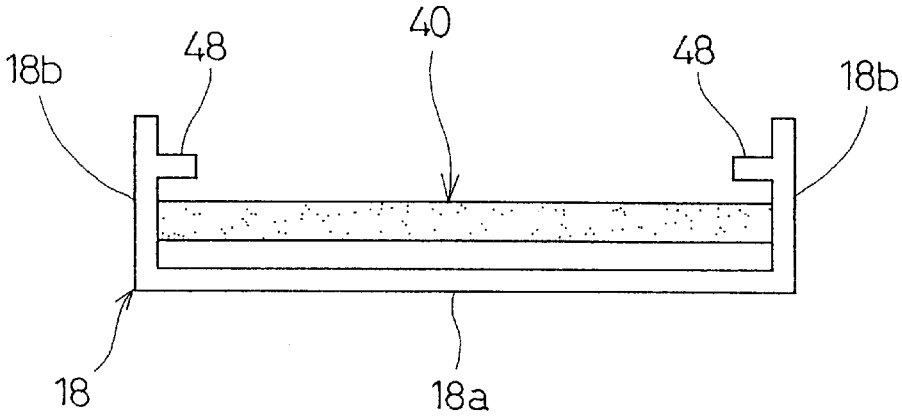
Figure 7:
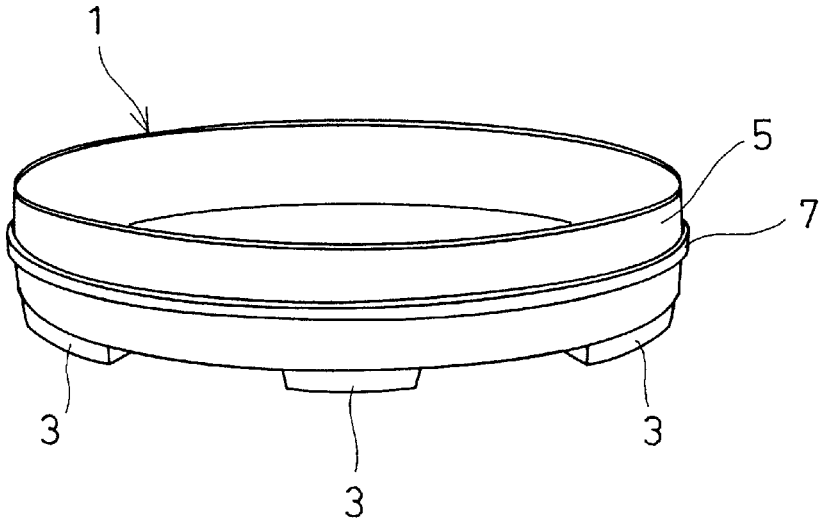
FIG.7 PRIOR ART
FIG. 7 is a perspective view showing a bottom structure of a conventional golf bag related to the present invention.
Figure 8:
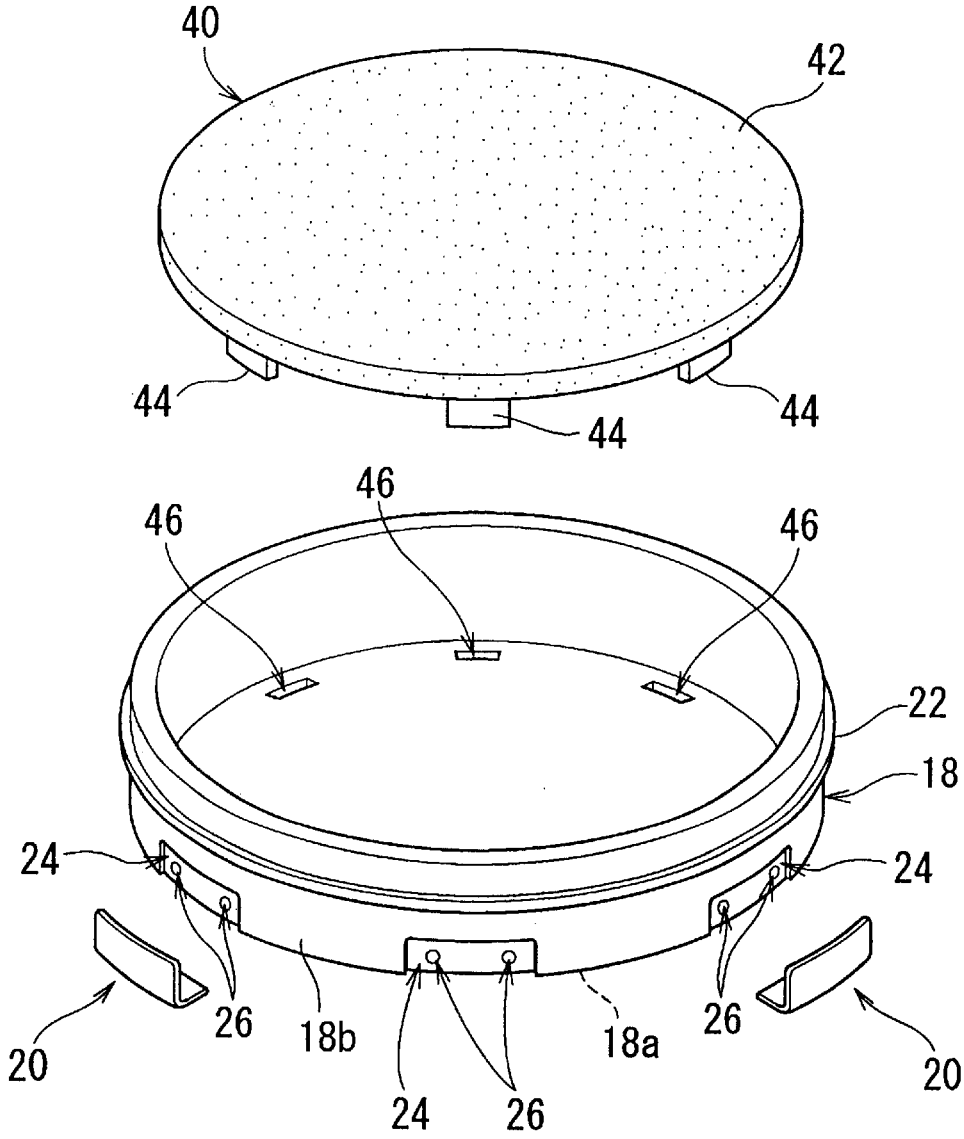
FIG. 8 is an exploded perspective view showing another configuration of a bottom structure included in the preferred embodiment shown in FIG. 1.

Note that, as a method for placing the cushion member 40 inside the bottom unit 18, instead of the method described above, as shown in FIGS. 6(A) and 6(B), for example, it is also possible to place the cushion member 40 between a ring-like flange piece 48 provided in the inner circumferential surface of the bottom unit 18 and the inner bottom surface of the bottom unit 18. In this case, the cushion member 40 is placed below the flange piece 48 under its elastic force, and therefore the flange piece 48 prevents the cushion member 40 from slipping off.

According to various preferred embodiments of the present invention, a golf bag is provided having a bottom structure that prevents the golf bag from slipping when placed on the ground, is excellent in cushioning property, and offers a wide design variety.

While the present invention has been particularly shown and described with reference to preferred embodiments thereof, it will be understood by those skilled in the art that the foregoing and other changes in form and details can be made without departing from the spirit and scope of the present invention.

What is claimed is:

1. A golf bag comprising:

a golf bag main body;

a bottom unit having a substantially cylindrical bottom structure disposed on an underside of the golf bag main body, said bottom unit having a side portion and a lower end surface, and through holes provided on said side portion and said lower end surface of said bottom unit; and at least one supporting leg member detachably attached to the bottom unit, said at least one supporting leg member includes a peripheral side portion attached to said side portion of the bottom unit and a bottom-side portion attached to said lower end surface of the bottom unit, and at least one snap retaining piece provided on each of said peripheral side portion and said bottom-side portion of said at least one supporting leg member to detachably and elastically engage said through holes provided on said side portion and said lower end surface of said bottom unit;

wherein the at least one supporting leg member is made of a non-slipping elastic material having a high friction coefficient and an excellent cushioning property.

2. The golf bag according to claim 1, wherein a roughened surface is disposed on a portion of a surface of the at least one supporting leg member that comes in contact with a ground.

3. The golf bag according to claim 2, wherein said roughened surface is defined by a plurality of groove lines.

4. The golf bag according to claim 1, wherein a decorative portion is provided on a portion of at least one of said peripheral side portion and said bottom-side portion.

5. The golf bag according to claim 1, wherein said at least one supporting leg member has a substantially L-shaped cross section.

6. The golf bag according to claim 1, wherein said bottom unit includes a substantially ring-shaped flange piece on an inner circumferential surface thereof to retain a cushion member in said bottom unit.

7. A golf bag comprising:

a golf bag main body;

a bottom unit having a substantially cylindrical bottom structure disposed on an underside of the golf bag main body; and at least one supporting leg member detachably attached to the bottom unit, of which at least one portion is located on a lower end surface of the bottom unit; wherein the supporting leg member is made of a non-slipping elastic material having a high friction coefficient and an excellent cushioning property a cushion member made of an elastic material having a cushioning property is provided inside the bottom unit; and said cushion member includes a substantially circular cushion body and a plurality of retaining leg pieces at the periphery of the substantially circular cushion body.

8. The golf bag according to claim 7, wherein said bottom unit includes retaining holes on an inner surface thereof and positioned to correspond to said retaining leg pieces of the cushion member.

* * * * *